United States Patent [19]

Schneider

[11] Patent Number: 4,664,639

[45] Date of Patent: May 12, 1987

[54] TUBE FISHERMAN'S FOOT FIN

[76] Inventor: John D. Schneider, 1413 Eton, Perryton, Tex. 79070

[21] Appl. No.: 764,623

[22] Filed: Aug. 12, 1985

[51] Int. Cl.[4] ..... A63B 31/11

[52] U.S. Cl. ..... 441/61

[58] Field of Search ..... 441/61-65, 441/77; D21/236-239

[56] References Cited

U.S. PATENT DOCUMENTS

| | | | |
|---|---|---|---|
| 915,457 | 3/1909 | Marrotte | 441/64 |
| 1,691,385 | 11/1928 | Fibiger | 441/61 |
| 1,745,280 | 1/1930 | Snapp | 441/61 |
| 1,983,609 | 12/1934 | Hudson | 441/61 |
| 2,395,844 | 3/1946 | Bufkin | 441/61 |
| 3,063,071 | 11/1962 | Van Vorst | 441/77 |
| 3,068,499 | 12/1962 | Von Biskupsky | 441/63 |
| 3,810,269 | 5/1974 | Tabata | 441/64 |

*Primary Examiner*—Joseph F. Peters, Jr.
*Assistant Examiner*—Paul E. Salmon
*Attorney, Agent, or Firm*—William J. Miller

[57] ABSTRACT

A tube Fisherman's foot fin is made of resilient material with one end attached to a shoe and a free end extending backward over the heel and a substantial distance behind the shoe; so that when the foot is extended forward the fin exerts little resistance against movement of the foot in the water. When the leg is extended backward or toward the rear of the fisherman, the fin provides a maximum resistance to movement of the foot to through the water; thereby propelling the fisherman forward through the water.

2 Claims, 5 Drawing Figures

TUBE FISHERMAN'S FOOT FIN

BRIEF DESCRIPTION OF THE PRIOR ART

Foot fins have been used for years for propelling swimmers or scuba divers through the water. Such fins have been designed so that when one is laying in the water the fins will propel a person forward by movement of the foot. That is the fin is designed to extend forward from the toe of the shoe, so that the swimming motion will create a forward force as the swimmer moves his legs upwardly and downwardly in the water. Such fins are exemplified by Patents issued to Marrotte, U.S. Pat. Nos. 915,457; 1,691,385 to A. F. Fibiger; U.S. Pat. No. 3,810,269 is Kazuo Tabata and U.S. Pat. No. 3,068,499 to W. Von Biskupsky. None of these Patents, however, is adapted for the art of tube fishing, where the person is vertical in the water, rather than horizontal in the water. A standard fin, when utilized by a person vertically positioned in the water, causes the person to move backwards rather than forwards when the fin is used. Such a motion renders the art of tube fishing, for example, extremely difficult, since the fisherman can not tell where he is moving and such movement may take him into brush, rocks or other hazardous areas, both to himself and to his fishing equipment.

The closest of the above Patents mentioned appears to be the Patent to W. Von Biskupsky which provides for a pivotal fin which can be positioned in either a forward position or a backward position. The pivoting of the fin, however, is for the sole purpose of providing the ability to walk and is not used in the water in the rearward position, but is used in the water in the forward position as is all of the prior art fins.

BRIEF DESCRIPTION OF THE INVENTION

This invention describes a fin which is particularly adapted to a fisherman who moves through the water in a vertical position. Further, it provides forward movement for the fisherman so that he can not only see where he is going, but can provide ease of walking over silt and dirt common in shallow water depths without becoming entangled due to the fins extending forwardly from the shoe. This Patent basically comprises a fin, which is attached to the sole of a shoe and extends rearwardly from the shoe to a distance substantially past the heel. It is also preferable wider than the sole of the shoe to provide additional force to the fisherman as he moves. The fin can be either molded as a unitary structure with the sole of the shoe, as is the preferred embodiment, or the fin can be attached over the shoe. Both fins, however, provide forward motion to the fisherman.

DETAILED DESCRIPTION OF THE INVENTION

Figure 1:
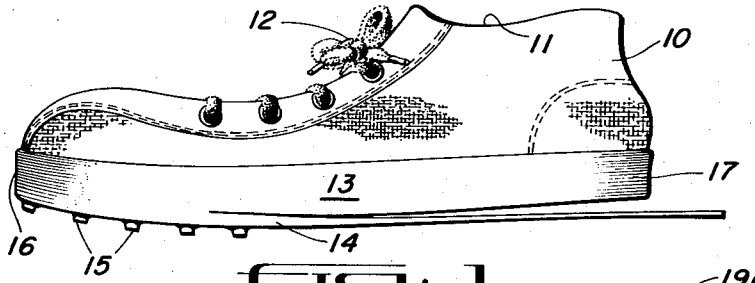
FIG. 1 illustrates a side view of a shoe having a fin attached to the shoe as a unitary structure with the sole of the shoe.

Referring to all of the FIGURES, but in particular to FIG. 1, a shoe 10 such as a canvas shoe, has an opening 11 for the insertion of a foot and is secured to the foot in the usual manner such as shoe strings 12. Shoe 10 includes a sole 13, which has attached thereto and molded as a unitary structure therewith, a fin 14. Sole 13 and fin 14 are preferably molded from an elastic or resilient material such as rubber or plastic.

Figure 2:
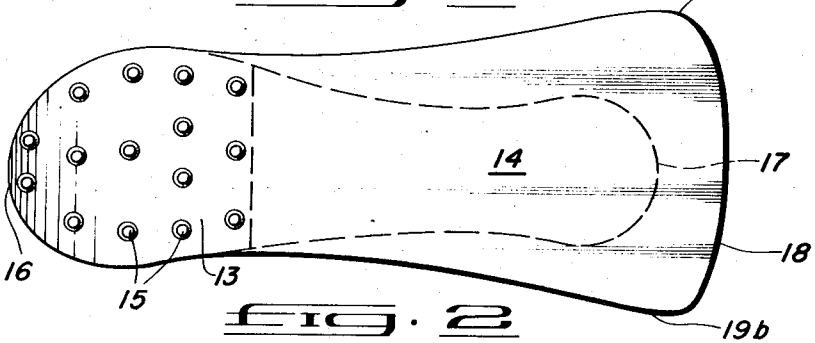
FIG. 2 is a bottom view of the fin shown in FIG. 1.

Fin 14 can be better illustrated by referring to FIG. 2. Here it is noted that fin 14 is formed as a integral part of sole 13 and may contain several cleats 15 to aide the fisherman walking on the surface of the earth. Fin 14 is mounted intermediate the toe 16 and the heel 17 of shoe 10 and extends rearwardly over the heel 17 to a distance 18 substantially past heel 17. Fin 14 also has a width from **19*a* to 19*b* which is determined by the force required to move the fisherman through the water. It generally can extend several inches on each side of the sole 13**.

Figure 3:
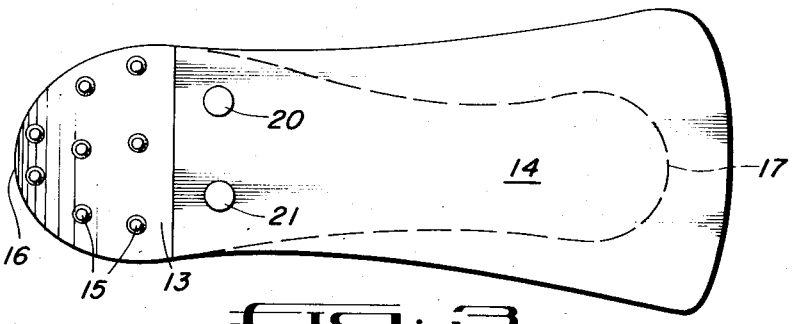
FIG. 3 is a bottom view of a fin attached by means of rivets or other means.

In FIG. 3, fin 14 is attached by means of rivets 20 and 21 to sole 13.

Figure 4:
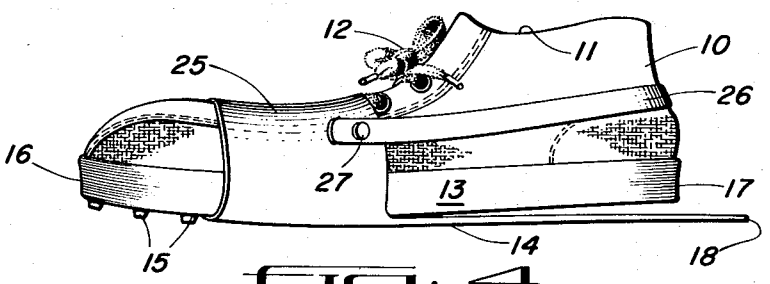
FIG. 4 is an illustration of a fin attached by sliding the apparatus over the shoe; and, FIG. 5 is an illustration of the use of the apparatus attached to a fisherman's foot.

A second alternate embodiment for fin 14 is illustrated in FIG. 4. Here fin 14 is attached through a elastic belt or strap 25 in a manner so that it will pass over shoe 10 at a location intermediate the toe 16 and heel 17. A second elastic belt or strap 26 passes over heel 17 and is attached on one side through a pin 27 and on the other side to a similar pin which is not shown. Pin 27 can also be a button, a snap, a buckle or any other suitable method for attaching strap 26.

Figure 5:
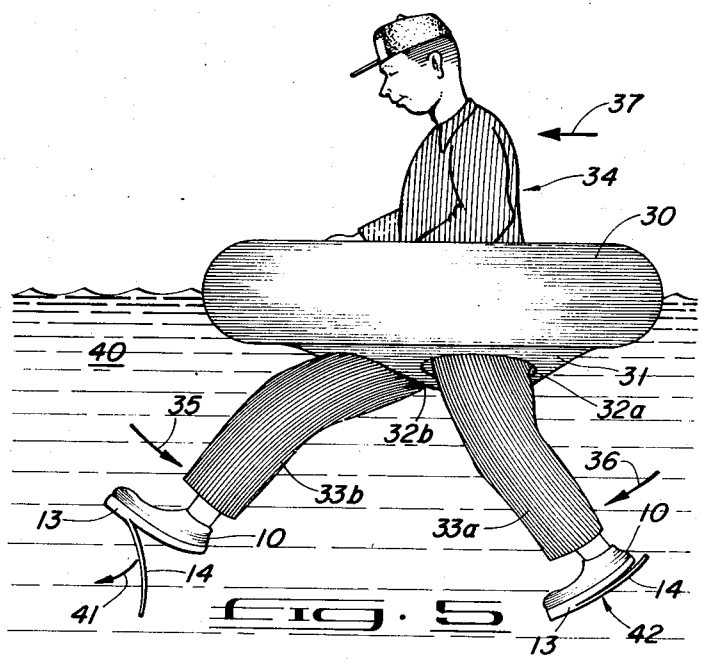

Referring to FIG. 5 a fisherman such as a tube fisherman is shown positioned vertically in the water in a tube 30 which has an elastic net 31 stretched over tube 30 with a pair of holes **32*a* and 32*b* formed therein adapted for receiving the legs 33*a* and 33*b* of a fisherman referred to by arrow 34. The invention is positioned on the feet of the fisherman and generally comprises shoe 10 with fin 14 attached to sole 13 as illustrated in FIGS. 1 and 2. The movement of the Fisherman's legs 33*a* and 33*b* as illustrated by arrows 35 and 36, while the direction of the fisherman is illustrated by arrow 37. Tube 30 is adapted for floating in a fluid such as water 40**.

OPERATION

The operation of the tube fisherman's fin 14 is best illustrated by reference to FIG. 5 and is as follows:

Under normal tube fishing conditions a fisherman will put on shoes 10 and place his legs **33*a* and 33*b* through openings 32*a* and 32*b* while holding tube 30 along with his fishing equipment. He will then walk into water 40 until the apparatus is floating on the surface of the water 40. He then can move himself through water 40 by extending leg 33*b* and pulling leg 33*b* in the direction of arrow 35. This action will cause fin 14 to deflect in the direction of arrow 41, creating a force against water 40 propelling the fisherman in the direction of arrow 37. Once the shoe 10 has reached the position such as illustrated by leg 33*a*, the foot must then be moved forward to assume the position as illustrated by leg 33*b*. If it is moved in the direction of arrow 36, fin 14 will move in the direction of arrow 42, collapsing against the undersole 13 of shoe 10 creating little or no drag on the movement of leg 33*a* in the direction of arrow 36**. Thus, when the fisherman moves his leg forward he will create little or no drag in the water and when he moves his leg backward he will cause a substantial drag in the water, thereby providing a continuous propulsion in the forward direction.

As an incidental advantage of these particular fins for tube fishermen, movement on the surface of the ground is extremely easy, since the fins extends backwards rather than forwards.

CONCLUSION

A extremely useful fin for vertically positioned fishermen has been illustrated. The fin provides for ease of movement in the forward direction through the water and ease of movement on the surface of the ground when getting into or out of the water. The fin can be either permanently attached to the sole of the shoe, as a continuous molded fin with the sole of the shoe; it can be attached by means of rivets or other means to the sole of a existing shoe or it can be slipped over the shoe using a elastic band and strap. It is obvious that changes or modifications can be made in the attachment of the fin to the foot or the size or the material of the fin and still be well within the teachings of this invention as defined in the specification or attached claims.

What I claim is:

1. A tube fisherman's foot fin for attachment to a shoe worn on the fisherman's foot having a sole with a toe and heel portion and wherein said hole has a length and a width comprising: a fin formed of flexible material and having an attachment end and a free end; means for rigidly securing said attachment end to the under portion of said shoe across the width of said sole to provide a flexure location, so that said free end extends beyond said heel of said shoe, said fin having a width extending beyond the width of said shoe, said fin attached to said sole so that said fine extends closely adjacent and substantially parallel to said sole during forward movement of said foot so as to cause said fin to have minimum drag in the water, while rearward motion of said foot will cause said fin to deflect away from said sole by flexing at said flexure location and to have maximum drag in the water, thereby propelling said tube fisherman forwardly.

2. Apparatus as described in claim 1 where said fin is secured by molding said attachment means to the sole of said shoe intermediate the toe and heel portion of said sole.

* * * * *